United States Patent [19]

Kenyon

[11] 4,347,720

[45] Sep. 7, 1982

[54] CHAIN LOCK

[76] Inventor: David L. Kenyon, 1727 W. Royalton Rd., Broadview Heights, Ohio 44147

[21] Appl. No.: 206,568

[22] Filed: Nov. 13, 1980

[51] Int. Cl.[3] ..... E05B 73/00

[52] U.S. Cl. ..... 70/14; 70/18; 70/34; 70/38 C

[58] Field of Search ..... 70/14, 18, 32, 33, 34, 70/386, 23, 15

[56] References Cited

U.S. PATENT DOCUMENTS

| | | | |
|---|---|---|---|
| 1,692,826 | 11/1928 | Ganz | 70/231 |
| 1,792,403 | 2/1931 | Stone | 70/33 |
| 1,921,434 | 8/1933 | Stone | 70/259 |
| 4,057,982 | 11/1977 | Drayton | 70/14 |

FOREIGN PATENT DOCUMENTS

| | | | |
|---|---|---|---|
| 1400699 | 7/1975 | United Kingdom | 70/14 |

*Primary Examiner*—Robert L. Wolfe

*Attorney, Agent, or Firm*—Pearne, Gordon, Sessions, McCoy & Granger

[57] ABSTRACT

A chain lock is disclosed which has an outer sleeve fitting over an inner cylindrical case having a recess for the insertion of a link of a chain. When the case is rotated within the sleeve, a locking member moves within the recess to prevent release of the chain link from the recess. A locking device fits within a bore of the case and extends through a hole in the sleeve to prevent rotation of the case within the sleeve. When the locking device is removed from the bore in the case, the case is free to rotate to allow the locking member to clear the recess and to permit the chain link to be removed. The ends of the chain and the locking mechanism are completely contained within the case of the lock preventing tampering with the locking mechanism or access to the chain. There are no internal latches or levers to jam and the chain lock generally conforms to the shape of the chain.

12 Claims, 12 Drawing Figures

CHAIN LOCK

BACKGROUND OF THE INVENTION

1. Field of the Invention

This invention relates to locking devices, and specifically to a lock adapted to secure the ends of a heavy chain.

2. Description of the Prior Art

Chains are often used to secure various movable items. For example, the use of chains as part of a security device is popular in the securing of motorcycles. When chains are used, the ends of the chains are often secured by a padlock or other similar locking device. Padlocks typically include a shackle or bow which fits through the end links of the chain and prevents separation of the chain ends.

Padlocks were not entirely suitable for this purpose because they were susceptible to breaking, since the shackle could be sawed or broken off to open the lock. In addition, the latching mechanism which held the end of the shackle within the case could become susceptible to jamming after an extended duration of time, preventing anyone from opening the lock with the key and resulting in extraordinary difficulties. The use of padlocks with chains was also undesirable because the padlock dangled from the chains and could be placed in a position in which the hardened case of the padlock damaged the item secured by the chain, such as the finish of a motorcycle.

SUMMARY OF THE INVENTION

The disadvantages and shortcomings of the prior art are overcome by the improved chain lock of the present invention. The present invention provides a lock which is specially adapted for securing the ends of a chain together and for preventing their release until the lock is unlocked. The chain lock eliminates the necessity for utilizing a padlock with its undesirable external shackle and its possibility of damage to items. The chain lock of the present invention does not have a shackle or bow which can be sawed or broken off. In addition, the lock is cylindrical in shape and generally conforms to the extent of the chain so that it does not dangle, but may be placed in line with the chain.

The chain lock has a solid body, preferably of hardened steel, which has no internal latches or levers likely to jam and which has smooth, outer surfaces which frustrate attempts to pry open the lock. The ends of the chain are enclosed within the case of the lock, preventing tampering with the locking mechanism in an attempt to frustrate the lock.

These and other objects are accomplished by the chain lock of the present invention, which comprises an outer sleeve having a hole through the sleeve and having an indentation in its interior surface. An inner cylindrical case fits within the sleeve and is capable of rotational movement within the sleeve between a locked position and an unlocked position. The case has a recess at one or both ends for insertion of a link of a chain. The case also has at least one passage transverse of the recess extending from the recess to an outer end through the outer surface of the case. The indentation in the sleeve is adjacent to the outer end of the passage when the case is in the unlocked position. The case has a cylindrical bore extending into it. The bore is coaxial with the hole in the sleeve when the case is in the unlocked position. A locking member is movable within the passage. The locking member is capable of fitting within the indentation in the sleeve to be clear of the recess when the case is in the unlocked position and is capable of partially blocking the recess to retain the chain link in the recess when the case is in the locked position. A locking device is slidably receivable within the bore in the case, and extends through the hole in the sleeve. The locking device has engaging means for retaining the device in the bore to hold the case in the locked position. The locking device is slidably removable from the bore to permit the case to be rotated to the unlocked position.

DETAILED DESCRIPTION OF THE PREFERRED EMBODIMENT

Figure 1:
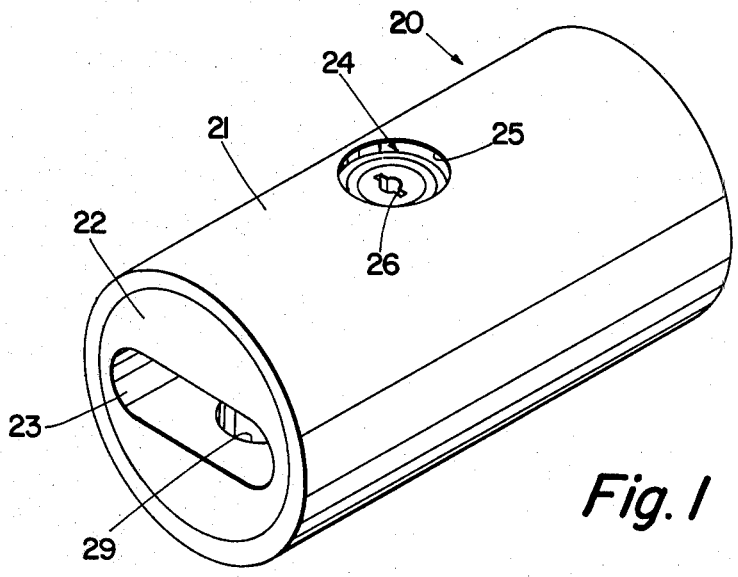
FIG. 1 is a perspective view of the chain lock of the present invention.

Referring more particularly to the drawings, and initially to FIG. 1, there is shown the chain lock 20 of the present invention. The lock 20 comprises an outer, tubular sleeve 21 and an inner cylindrical case 22 which fits within the sleeve 21. The case 22 is rotatable within the sleeve 21 and both are preferably formed of hardened steel and, together, provide a smooth, outer surface. At each end of the case 22 is an oblong recess 23 which extends into the case 22 and is adapted for the insertion of the end link of chain. The chain lock 20 also has a locking device 24 set in a hole 25 formed on the outside surface of the sleeve 21 at approximately the middle of the lock. The locking device 24 has a keyway 26 adaptable for the insertion of the key which is used to lock and unlock the locking device.

Figure 2:
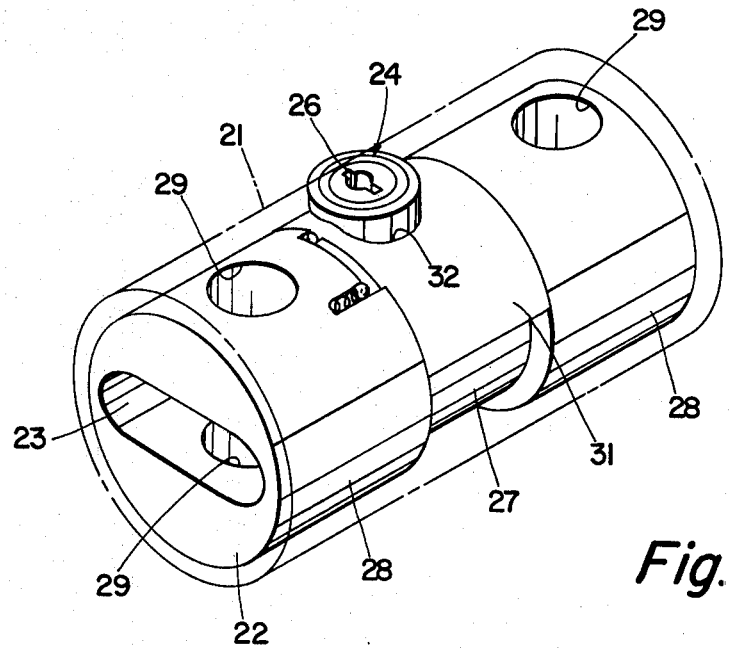
FIG. 2 is a perspective view of the lock of FIG. 1, with the outer sleeve removed.
Figure 3:
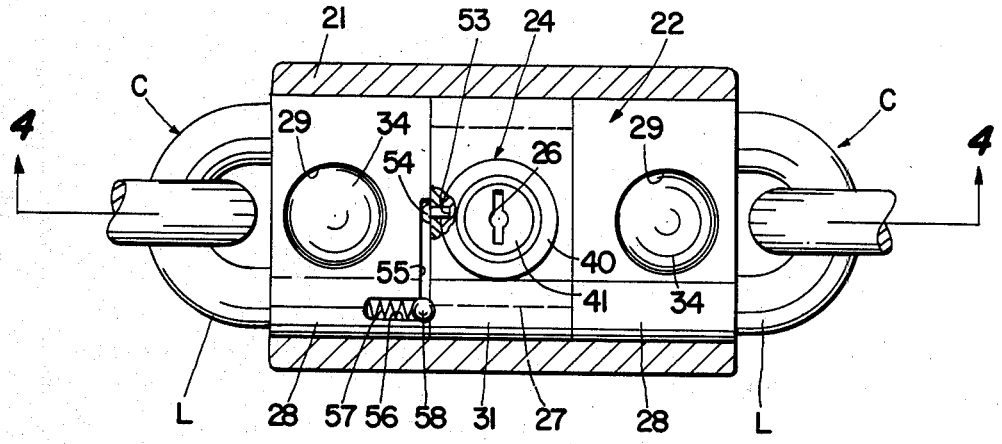
FIG. 3 is a top plan view of the lock of FIGS. 1 and 2 in the locked position, with the outer sleeve sectioned and partially removed.

The inner case 22 can be seen in greater detail in FIG. 2, in which the sleeve 21 has been removed and is indicated only in broken lines. The case 22 is generally cylindrical, resembling a dumbbell in shape, with a central, smaller diameter portion 27 between two larger diameter portions on each end. The locking device 24 is located approximately in the middle of the smaller diameter portion 27. The recesses 23 extend inwardly from each end of the case 22 into each of the larger diameter portions 28. Circular holes 29 extend through each of the larger diameter portions 28 transverse to each of the recesses 23. A saddle 31 fits around the smaller diameter portion 27 of the case, and extends on either side of the locking device 24. A saddle 31 has a central hole 32 through which the locking device 24 extends. The outer surface of the saddle 31 conforms to the outer surface of the larger diameter portions 28 of the case 22 to provide a continuous cylindrical shape with fits within the sleeve 21.

The operation of the chain lock and the further details of its construction can be understood with reference to FIGS. 3–12. FIGS. 3–7 depict the chain lock 20 in its locked position, and FIGS. 8–12 depict the lock in its unlocked position.

Figure 4:
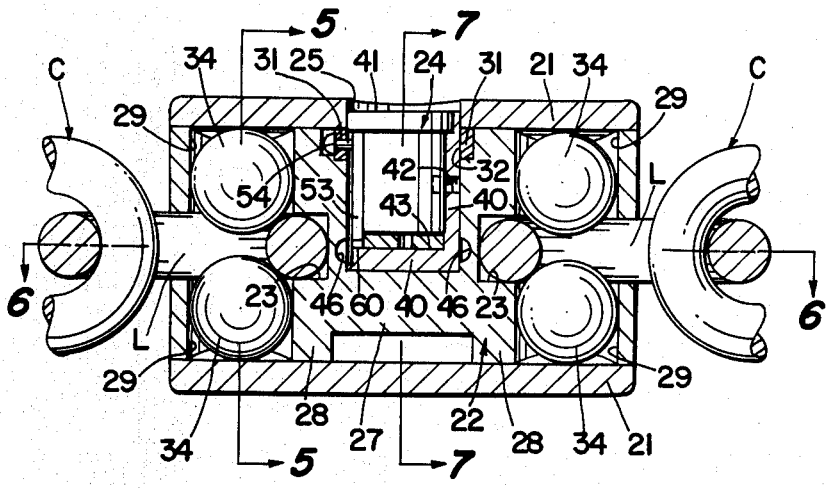
FIG. 4 is a side sectional view of the lock in the locked position, taken along line 4—4 of FIG. 3.
Figure 5:
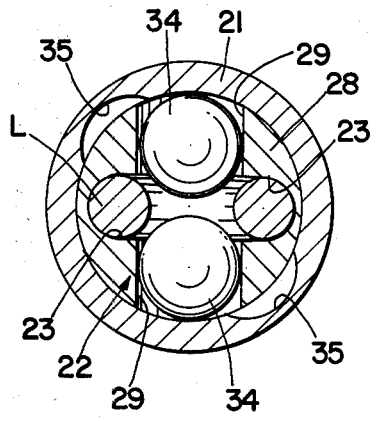
FIG. 5 is an end sectional view, taken along line 5—5 of FIG. 4.

In FIGS. 3–7, a chain C has been inserted into the lock with the links L at each end of the chain inserted into the recesses 23 at each end of the case 22. The links L are held in the lock by locking members comprising balls 34 located in each of the holes 29. Each of the balls 34 is sufficiently large so that, when one of the balls is placed in each of the holes 29 and is retained within the case 22 by the sleeve 21, each ball 34 extends a sufficient distance into the recess 23 to prevent the link L from being removed from the recess (FIGS. 4 and 5). The holes 29 are each dimensioned to have approximately the same inner diameter as the outer diameter of the balls 34, so that the balls 34 are movable within the holes 29 laterally with respect to the extent of the recess 23.

Each of the balls 34 is retained inwardly by engagement with the inner surface of the sleeve 21. The inner surface of the sleeve 21 also has indentations 35 (FIG. 5) at the axial position of each set of holes 29, but angularly spaced from the ends of the holes when the chain lock is in its locked position, as shown in FIG. 5. When the inner case 22 is rotated with respect to the sleeve 21, the holes 29 are moved so that the outer end of each of the holes is adjacent to one of the indentations 35, permitting each of the balls 34 to move radially outwardly away from the recess 23 so that the chain links L may be removed from the recess.

Figure 7:
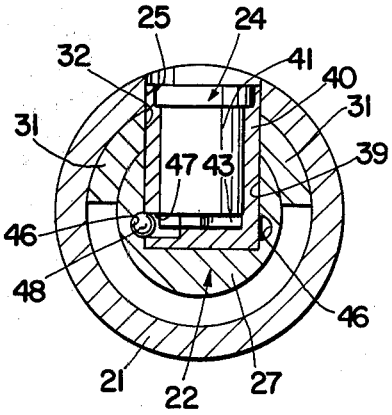
FIG. 7 is an end sectional view, taken along line 7—7 of FIGS. 4 and 6.
Figure 8:
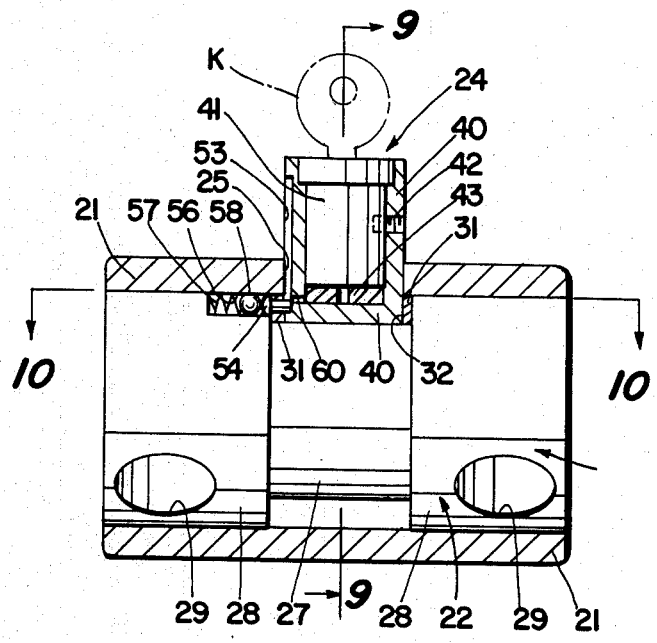
FIG. 8 is a side elevational view, partially in section, of the chain lock in the unlocked position.
Figure 9:
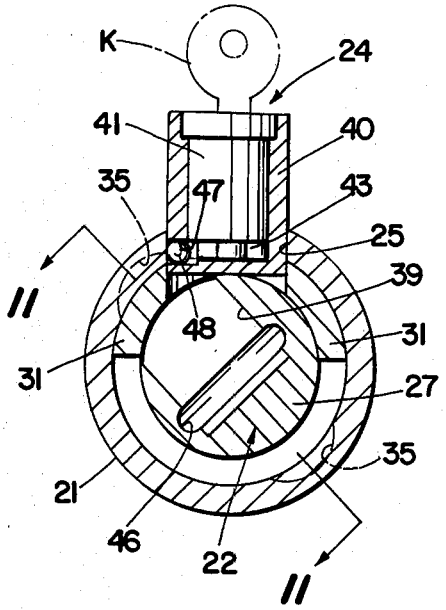
FIG. 9 is an end sectional view of the lock in the unlocked position, taken along line 9—9 of FIG. 8.

The locking device 24 prevents the case 22 from rotating with respect to the sleeve 21 and maintains the chain lock 20 in its locked position. The locking device 24 comprises an attached cup 40 and lock cylinder 41 (FIGS. 4 and 7). The cup 40 has a hollow interior and the cylinder 41 is securely mounted within it by means of a removable setscrew 42 (FIG. 4). If desired, two setscrews 41 may be used, one on each side of the cup 40. The cylinder 41 is of conventional design comprising a nonrotatable outer housing which is secured to the cup 40 by the setscrew 42, and a conventional internal locking mechanism which is capable of turning only when a key is inserted into the keyway 26, activating tumblers in the internal locking mechanism. A rotatable camming disc 43 is connected to the internal locking mechanism and is mounted at the bottom end of the lock cylinder 41. By inserting a key into the keyway 26 and turning the key, the tumblers are activated, and the locking mechanism turns, resulting in rotation of the connected camming disc 43.

The locking device 24 extends through the hole 25 in the outer sleeve 21, through the hole 32 in the saddle 31, and extends into a cylindrical bore 39 formed in the middle of the smaller diameter portion 27 of the case 22. By extending into the inner case 22 and the hole 25 in the outer sleeve 21, the locking device 24 prevents rotation of the case 22 with respect to the sleeve 21.

Figure 6:
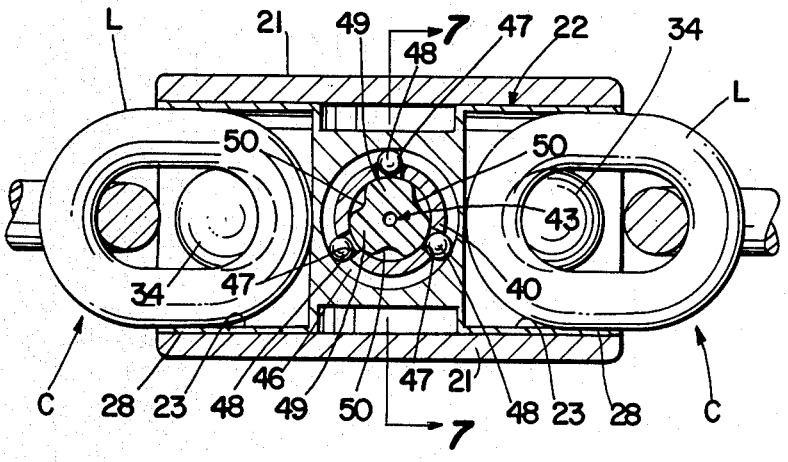
FIG. 6 is a top sectional view, taken alone line 6—6 of FIG. 4.
Figure 10:
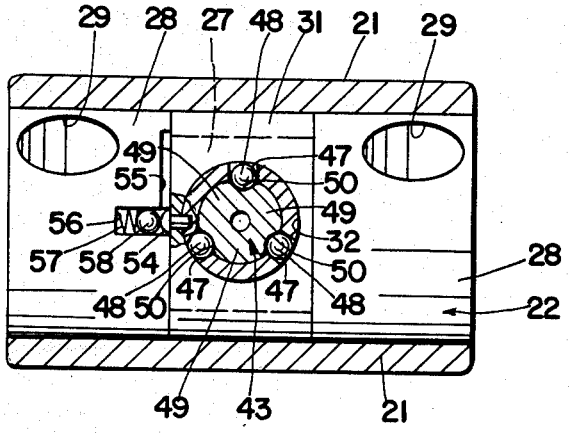
FIG. 10 is a top plan view, partially in section, of the lock in the unlocked position, taken along line 10—10 of FIG. 8.
Figure 11:
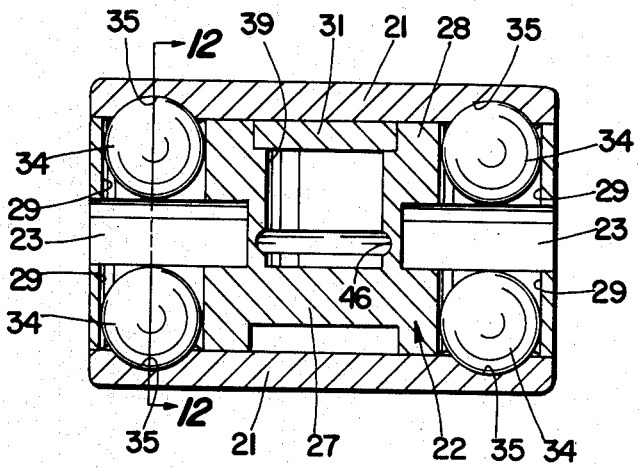
FIG. 11 is a side sectional view, taken along line 11—11 of FIG. 9.
Figure 12:
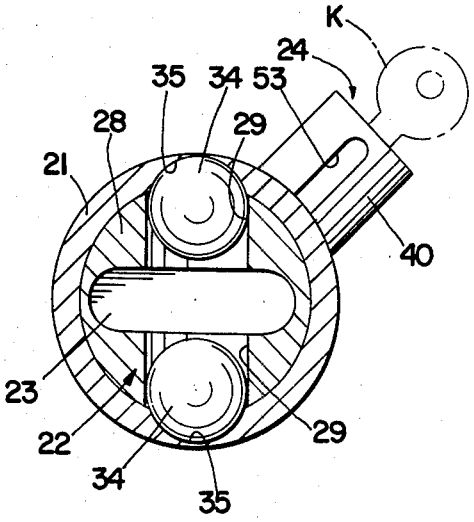
FIG. 12 is an end sectional view, taken along line 12—12 of FIG. 11.

The locking device 24 is slidable within the cylindrical bore 39 in the case 22. Engaging means is provided for retaining the locking device 24 in the bore 39 to hold the case 22 in the locked position. The engaging means includes an annular groove 46 (FIGS. 4 and 6) which extends into the case 22 from the interior wall of the bore 39 near the bottom of the bore. A plurality of holes 47 extend through the wall of the cup 40 around its bottom portion (FIG. 6). A retractable engaging member, preferably a ball bearing 48, is placed in each of the holes 47. In the preferred embodiment of the present invention, three holes 47, each containing a bearing 48, are provided (FIG. 6). The lock cylinder 41 secured within the cup 40 has mounted at its lower end a camming means, such as the rotatable camming disc 43, having projections 49 and recesses 50. The camming disc 43 is capable of rotating only when the key and the internal locking mechanism of the lock cylinder 41 rotates. The number of projections 49 and recesses 50 on the camming disc 43 corespond to the number of bearings 48 within the holes 47 of the cup 40. The projections 49 and the recesses 50 are proportioned such that, when the projections 49 of the camming disc 43 are opposite the holes 47, the bearings 48 project outwardly through the holes 47 beyond the outer surface of the cup 40 (FIG. 6). When the locking device 24 is in the locked position, the projecting bearings 48 fit within the annular groove 46 in the bore 39 (FIG. 7). However, when the recesses 50 are adjacent the holes 47, the bearings 48 fit within the recesses 50 and do not project from the outer surface of the cup 40 (FIG. 10). When the locking device 24 is in the unlocked position, the bearings 48 retract within the cup 40, and the entire locking device 24 is slidably movable within the bore 39. The locking device 24 can then be pulled upwardly until it is completely clear of the bore 39. With the locking device 24 removed from the case 22, the case 22 is free to rotate within the sleeve 21, and the chain lock can be moved to its unlocked position.

To restrain the locking device 24 and prevent its removal from the sleeve 21, the cup 40 has a longitudinal groove 53 along its side (FIG. 4). A retaining member, such as a rivet or pin 54, is mounted in an opening in the saddle 31 and extends into the hole 32 of the saddle. The head of the pin 54 is rounded, and the tail of the pin fits within the groove 53. As the locking device 24 slides within the bore 39 in the case 22, the pin 54 moves within the longitudinal groove 53, preventing the locking device from being completely removed from the hole 32 in the saddle, and thus preventing removal of the locking device from the sleeve 21 and the entire chain lock. The circumferentially extending channel 55 (FIG. 3) is formed on the inward end of the larger diameter portion 28 of the case 22 adjacent to the pin 54 to provide clearance for the pin 54 as the case 22 is rotated from its locked position to its unlocked position. At one end of the channel 55, a longitudinal slot 56 is provided in the outer surface of the larger diameter portion 28 of the case to allow for removal of the pin 54. A small spring 57 and a ball bearing 58 are provided within the slot 56. When the pin 54 has been moved to its unlocked position (FIG. 10), the rounded head of the pin pushes the ball bearing 58 into the slot 56 and compresses the spring 57. A small hole 60 extends through the cup 40 near the bottom of the groove 53 to permit removal of the pin 54.

To operate the chain lock 20 of the present invention, a key K is placed within the keyway 26 of the locking device 24, and the key is turned. The key K activates the tumblers within the lock cylinder 41 and allows the internal locking mechanism to turn, thereby rotating the camming disc 43 mounted on the bottom of the lock cylinder. The nonrotatable outer portion of the lock cylinder 41 remains fixedly secured to the cup 40 by the setscrew 42. As the camming disc 43 is rotated, the projections 49 in the disc 43 move away from the holes 47 in the cup 40, and the recesses 50 move into a position adjacent the holes 47 (FIG. 10). This allows the bearings 48 to retract into the holes 47 and clear of the annular groove 46. With the bearings 48 removed from the groove 46, the locking device 24 is free to slide out of the bore 39 in the case 22. As the locking device 24 slides out of the bore 39, it is restrained by the engagement of the pin 54 in the groove 53 in the cup 40. When the locking device 24 is pulled out clear of the bore 39, the case 22 can be rotated with respect to the sleeve 21. As the case 22 is rotated, the saddle 31 remains fixed in position with respect to the sleeve 21, since the locking device 24 extends through both the hole 32 in the saddle 31 and the hole 25 in the sleeve 21. As the case 22 rotates, the pin 54 moves within the channel 55 until the rounded head of the pin 54 engages the ball 58 and pushes the ball into the slot 56, compressing the spring 57. When the pin 54 reaches this point, it is restrained from further circumferential movement by engagement with the end of the channel 55. When the case 22 is in this position, the balls 34 are in a position in which they fit within the indentations 35 formed in the interior of the sleeve 21, and the chain lock 20 is in its unlocked position (FIGS. 8–12). The balls 34 move outwardly through the holes 29 and the retract into the indentations 35 so that they are completely clear of the recess 23. The links L are then free to be removed from the recess 23. The reverse procedure is used to lock the chain lock with the chain links L reinserted into the recesses 23.

Another feature of the chain lock of the present invention is that the elements can be disassembled to replace worn or defective parts, but only when the chain lock is in the unlocked position. To disassemble the lock 20, the lock is first unlocked so that the locking device 24 is fully removed from the bore 39 and the case 22 is rotated so that the pin 54 is adjacent to the slot 56. The lock cylinder 41 is removed from the cup 40 by removal of the setscrew 42. With the cylinder 41 removed, a small tool may be inserted into the empty cup 40 and into the hole 60 to push the pin 54 back against the ball 58 and further compress the spring 57. With the pin 54 removed from the groove 53, the cup 40 may then be removed from the hole 32 in the saddle 31 and from the hole 25 in the sleeve 21. It can be seen that when the empty cup 40 is removed, the bearings 48, which are placed in the holes 47, are easily removable. With the entire locking device 24 removed from the chain lock, the sleeve 21 slides off the case 22 and permits complete disassembly of the lock. The reverse procedure is used to assemble the padlock. Preferably, the lower edge of the cup 40 is beveled at one portion thereof to permit the cup to be inserted back into the hole 32 in the saddle 31. The beveled portion contacts the pin 54 and provides a camming action to push the pin back against the spring 57 to permit the cup 40 to be inserted.

While the invention has been shown and described with respect to a specific embodiment thereof, this is intended for the purpose of illustration rather than limitation, and other modifications and variations will be apparent to those skilled in the art, all within the intended spirit and scope of the invention.

What is claimed is:

1. A chain lock which comprises:

an outer sleeve having a hole therethrough and having an indentation in its interior surface;

an inner cylindrical case within the sleeve and capable of rotational movement within the sleeve between a locked position and an unlocked position, the case having a recess at one end for insertion of a link of a chain, the case also having a passage transverse of the recess extending from the recess to an outer end through the outer surface of the case, the indentation in the sleeve being adjacent to the outer end of the passage when the case is in the unlocked position, the case having a cylindrical bore extending into it, the bore being coaxial with the hole in the sleeve when the case is in the locked position;

a locking member movable within the passage, the locking member capable of fitting within the indentation in the sleeve to be clear of the recess when the case is in the unlocked position and capable of partially blocking the recess to retain the chain link in the recess when the case is in the locked position; and a locking device slidably receivable within the bore in the case and extending through the hole in the sleeve, the locking device having engaging means for retaining the device in the bore to hold the case in the locked position, the locking device slidably removable from the bore to permit the case to be rotated to the unlocked position.

2. A chain lock as defined in claim 1, comprising in addition means for retaining the locking device in the hole to prevent removal of the locking device from the sleeve.

3. A chain lock as defined in claim 1, wherein the engaging means of the locking device comprise detent means capable of engaging corresponding groove means within the bore.

4. A chain lock as defined in claim 1, wherein the locking device comprises a cup slidably receivable within the bore in the case, the cup being movable between a locked position in which it is fully inserted within the case and an unlocked position in which it is clear of the case, the cup having a retractable locking member projecting from a hole in the wall of the cup, the locking member being capable of fitting within a groove on the interior wall of the bore to hold the cup in the locked position and capable of retracting into the hole to free the cup when in the unlocked position, and a lock cylinder fixedly mounted within the cup having an interior locking mechanism operatively connected to a camming means for forcing the locking member to project outwardly through the hole when the locking mechanism is locked and allowing the locking member to retract inwardly when the locking mechanism is unlocked.

5. A chain lock as defined in claim 4, wherein the retractable locking member is a spherical bearing mounted within the hole.

6. A chain lock as defined in claim 4, wherein the cup has at least three holes in its wall and has three of the retractable locking members, one mounted within each hole.

7. A chain lock as defined in claim 1, wherein:

the outer sleeve has a second indentation;

the case has a second recess at the other end for the insertion of another link of a chain, the case also having a second passage transverse of the second recess extending from the second recess to an outer end through the outer surface of the case, the second indentation in the sleeve being adjacent to the outer end of the second passage when the case is in the unlocked position; and the chain lock also comprises a second locking member movable within the second passage, the second locking member capable of fitting within the second indentation in the sleeve to be clear of the second recess when the case is in the unlocked position and capable of partially blocking the recess to retain the chain link in the second recess when the case is in the locked position.

8. A chain lock as defined in claim 1, wherein:

the outer sleeve has a second indentation;

the case has a second passage transverse of the recess extending from the recess to an outer end through the outer surface of the case on the other side from the first passage, the second indentation in the sleeve being adjacent to the outer end of the second passage when the case is in the unlocked position; and the chain lock also comprising a second locking member movable within the second passage, the second locking member capable of fitting within the second indentation in the sleeve to be clear of the recess when the case is in the unlocked position and capable of partially blocking the recess to retain the chain link in the recess when the case is in the locked position.

9. A chain lock as defined in claim 8, wherein the first and second passages are coaxial.

10. A chain lock as defined in claim 1, wherein the locking member is spherical.

11. A chain lock as defined in claim 1, comprising in addition a saddle mounted on the case within the sleeve, the saddle having a hole which is coaxial with the hole in the sleeve, the locking device extending through the hole in the saddle.

12. A chain lock which comprises:

a tubular outer sleeve having a hole therethrough and having indentations in its interior surface;

an inner cylindrical case within the sleeve having a central smaller diameter portion between larger diameter portions, the case capable of rotational movement within the sleeve between a locked position and an unlocked position, the case having a recess at each end for insertion of links of a chain, the case also having a pair of coaxial passages transverse of each of the recesses, each passage extending from one of the recesses to an outer end through the outer surface of the case, the indentations in the sleeve being adjacent to the outer ends of each of the passages when the case is in the unlocked position, the case having a cylindrical bore extending into it, the bore having an annular groove near the bottom of the bore, the bore being coaxial with the hole in the sleeve when the case is in the unlocked position;

locking members each movable within one of the passages, each locking member capable of fitting within one of the indentations in the sleeve to be clear of the recesses when the case is in the unlocked position and capable of partially blocking one of the recesses to retain the chain link in the recess when the case is in the locked position;

a saddle mounted on the smaller diameter portion of the case within the sleeve, the saddle having a hole which is coaxial with the hole in the sleeve;

a locking device slidably receivable within the bore in the case and extending through the hole in the sleeve and through the hole in the saddle, the locking device comprising a cup slidably receivable within the bore in the case and extending through the hole in the sleeve, the cup having a longitudinal groove extending along its side, the cup being movable between a locked position in which the cup is fully inserted into the bore and an unlocked position in which the cup is clear of the bore, the cup having at least three retractable bearings projecting from holes in the wall of the cup capable of fitting within the annular groove in the bore to hold the cup in the locked position and capable of retracting into the hole to free the cup to move out of the bore when in the unlocked position, the locking device also comprising a lock cylinder fixedly mounted within the cup having an interior locking mechanism operatively connected to a camming means for forcing the bearings to project outwardly through the holes when the locking mechanism is locked and allowing the bearing to retract inwardly when the locking mechanism is unlocked; and a retaining member mounted on the saddle and engaging the longitudinal groove along the side of the cup to retain the locking device in the holes in the saddle and in the sleeve to prevent removal of the locking device from the sleeve.

* * * * *